US006170946B1

(12) United States Patent
Yasui et al.

(10) Patent No.: US 6,170,946 B1
(45) Date of Patent: Jan. 9, 2001

(54) IMAGE FORMING DEVICE

(75) Inventors: Tsuneo Yasui; Hakudai Kondo, both of Nagoya; Akira Sago, Seto; Kazuhiko Matsuda, Kounan; Masashi Suzuki, Nagoya, all of (JP)

(73) Assignee: Brother Kogyo Kabushiki Kaisha, Nagoya (JP)

( * ) Notice: Under 35 U.S.C. 154(b), the term of this patent shall be extended for 0 days.

(21) Appl. No.: 09/018,557

(22) Filed: Feb. 4, 1998

(30) Foreign Application Priority Data

Feb. 5, 1997 (JP) ..... 9-022997

(51) Int. Cl.[7] ..... B41J 29/13
(52) U.S. Cl. ..... 347/108; 347/23
(58) Field of Search ..... 347/22, 29, 36, 347/108, 23, 88, 19, 49

(56) References Cited

U.S. PATENT DOCUMENTS 4,450,456 * 5/1984 Jekel et al. ..... 347/29
5,392,065 * 2/1995 Suzuki ..... 347/88
5,499,043 * 3/1996 Osaka ..... 347/108
5,659,342 * 8/1997 Lund et al. ..... 347/35
5,742,302 * 4/1998 Kohri et al. ..... 347/23
5,821,955 * 10/1998 Waschhauser ..... 347/36
6,030,073 * 2/2000 Coiner et al. ..... 347/84

FOREIGN PATENT DOCUMENTS 5-64895 * 3/1993 (JP) ..... 347/33
5-278229 10/1993 (JP) .
8-224892 9/1996 (JP) .

* cited by examiner

*Primary Examiner*—N. Le
*Assistant Examiner*—Shih-Wen Hsieh
(74) *Attorney, Agent, or Firm*—Oliff & Berridge, PLC

(57) ABSTRACT

An image forming device provided with a main cover 6 that is capable of freely opening and closing and that covers an internally provided recording medium feed mechanism and the area scanned by the recording head during recording operations; and a maintenance cover 7 that is provided separately from the main cover in order to cover the maintenance mechanism and that is capable of freely opening and closing. Being provided separately from the main cover, the maintenance cover can be constructed relatively small and is, therefore, easy to open and close when replacing the maintenance paper. In addition, by only opening the maintenance cover while the recording head is positioned in the scanning area, the temperature of the recording head is not lowered.

18 Claims, 5 Drawing Sheets

IMAGE FORMING DEVICE

BACKGROUND OF THE INVENTION

1. Field of the Invention

The present invention relates to an image forming device and particularly to an image forming device of a type provided with a recording head maintenance mechanism.

2. Description of the Related Art

There is conventionally proposed an image forming device of a type provided with a recording head maintenance mechanism.

SUMMARY OF THE INVENTION

FIGS. 1(*a*) and 1(*b*) show a conceivable image forming device which is capable of recording images on a recording medium having a large size, such as an A0-size paper, while freely setting the length of a recording area to various lengths.

As shown in the drawings, this type of image forming device includes a main body 110. A cover 60 is provided on the top of the main body 110 covering an area in which an internally-provided recording head 70 scans over a recording medium P. The cover 60 can be freely opened or closed in order to replace a recording paper roll with a new one and also to perform a maintenance operation on a recording medium feed mechanism.

FIG. 1(*a*) is an external view of the conceivable image forming device when the cover 60 is in the closed position, while FIG. 1(*b*) shows the same device when the cover 60 is in the open position. The cover 60 is closed during normal recording operations and is opened when replacing the recording paper roll with a new one and cleaning or repairing the feed mechanism for the recording medium P. Since the internal mechanisms of the main body 110 are exposed when the cover 60 is in the open position, recording operations of the image forming device are controlled to shut off when the cover 60 is opened, in order to maintain a safe environment for maintenance work.

However, since the outer form of the above-described image forming device is necessarily large to accommodate such large recording media P as A0-size papers, the cover 60 must also be large and heavy. Accordingly, opening and closing of the cover 60 cannot be performed with ease.

Further, the cover 60 is also opened when replacing with a new one, a maintenance paper (not shown) provided for cleaning the recording head. Also at this time, the recording head becomes exposed to the outside air, which lowers the temperature of the recording head.

In hot melt ink type image forming devices, the printing head has to be maintained at a specific temperature to keep the hot melt ink in a melted condition. A decline in this temperature, caused by exposure to the outside air, can therefore cause problems in the ink ejection process.

Further, since the recording operations are stopped even when the maintenance paper is replaced with a new one, recording efficiency becomes low.

In view of the foregoing, it is an object of the present invention to provided an improved image forming device that allows the cover, used to access the internal maintenance mechanism, to be opened for maintenance work, such as replacing the maintenance paper with a new one, without causing reduction in the temperature of the recording head.

It is another object of the invention to provide an improved image forming device, on which the cover of the internal maintenance mechanism can be easily opened and closed.

In order to attain the above and other objects, the present invention provides an image forming device comprising: a recording medium feed mechanism for feeding a recording medium at a predetermined recording scanning area; a recording head capable of recording images on the recording medium fed at the predetermined recording scanning area; a scanning mechanism for moving the recording head relative to the recording mechanism to cause the recording head to scan the recording medium at the recording scanning area and for moving the recording head to a maintenance area which is positioned adjacent to the recording scanning area; a maintenance mechanism provided at the maintenance area for performing a cleaning operation onto the recording head; a device main body enclosing therein the recording medium feed mechanism, the recording head, the scanning mechanism, and the maintenance mechanism; a main cover provided to the device main body at the recording scanning area, the main cover being capable of being opened and closed with respect to the device main body, the main cover being opened to enable an access to the recording medium feed mechanism and the recording head being positioned at the recording scanning area; and a maintenance cover provided to the device main body at the maintenance area, the maintenance cover being capable of being opened and closed with respect to the device main body, the maintenance cover being opened to enable an access to the maintenance mechanism.

According to another aspect, the present invention provides an image forming apparatus comprising: a recording device for scanning and recording images on a recording medium; a maintenance mechanism positioned adjacent to one end of the area scanned by the recording device during recording operations; a recording medium feed mechanism for feeding the recording medium relative to the recording device; a device body housing the recording device, the maintenance mechanism, and the recording medium feed mechanism; a main cover attached to the device body and being capable of freely opening and closing, the main cover covering over the recording medium feed mechanism and the area scanned by the recording device during recording operations; and a maintenance cover attached to the device body and being capable of freely opening and closing, the maintenance cover being provided separately from the main cover and covering over the maintenance mechanism.

DETAILED DESCRIPTION OF THE PREFERRED EMBODIMENT

An image forming device according to the preferred embodiment of the present invention will be described while referring to the accompanying drawings.

Figure 1A:
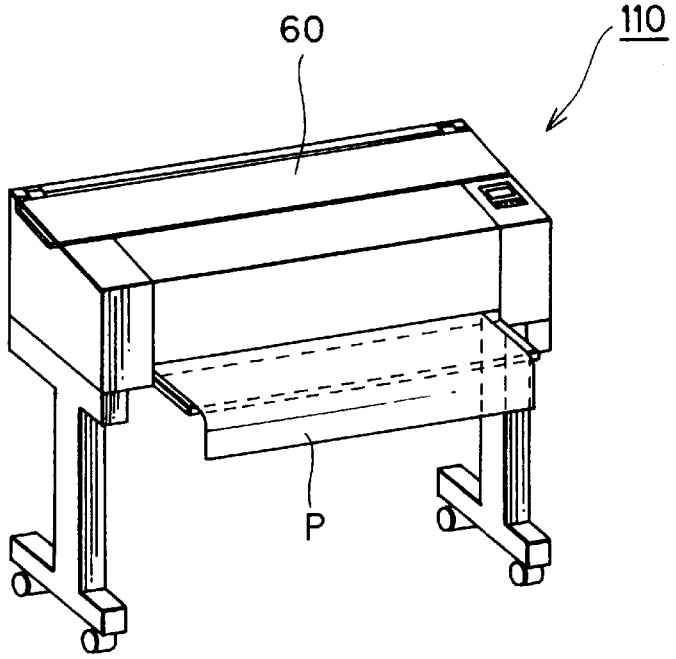
FIGS. 1(*a*) and 1(*b*) show external view of a conceivable image forming device, wherein a cover is in the closed position in FIG. 1(*a*) and the cover is in the open position in FIG. 1(*b*)
Figure 1B:
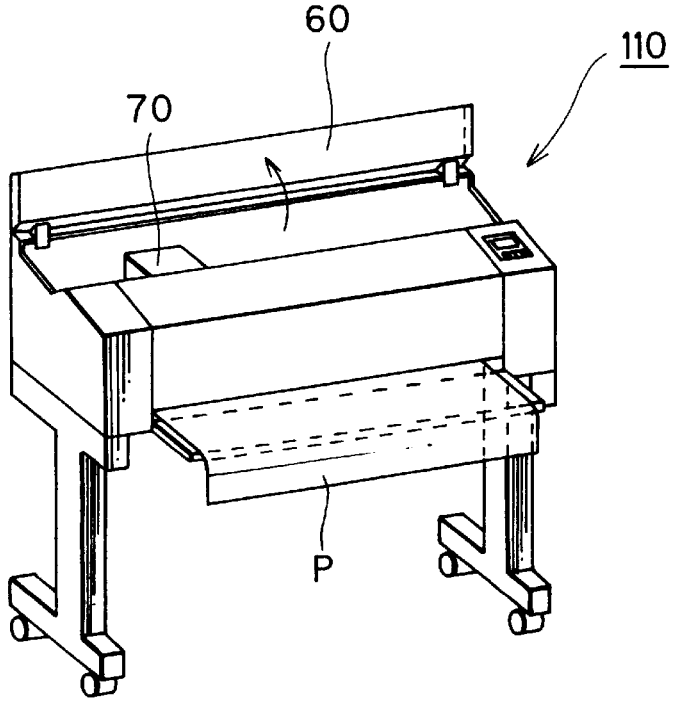
Figure 2:
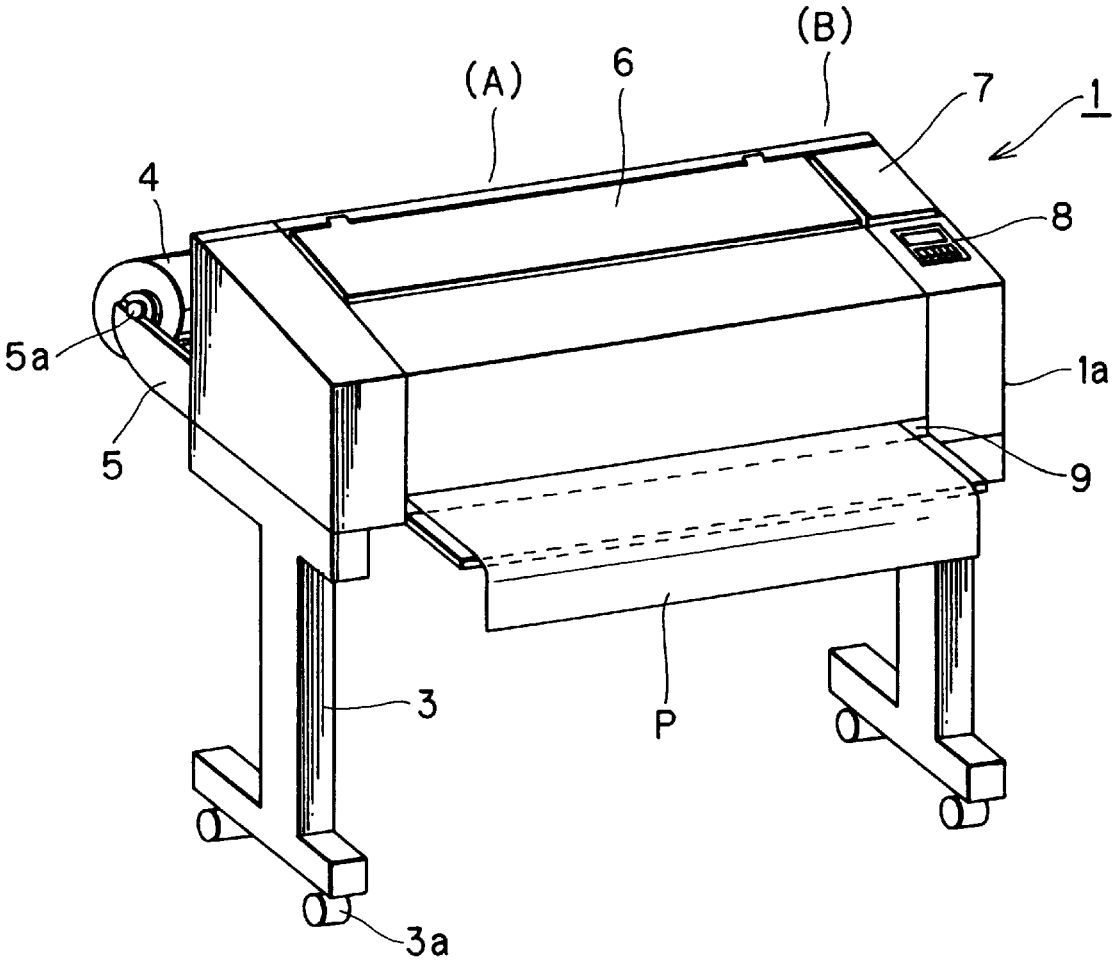
FIG. 2 is an external view of an image forming device according to a preferred embodiment of the present invention.
Figure 3:
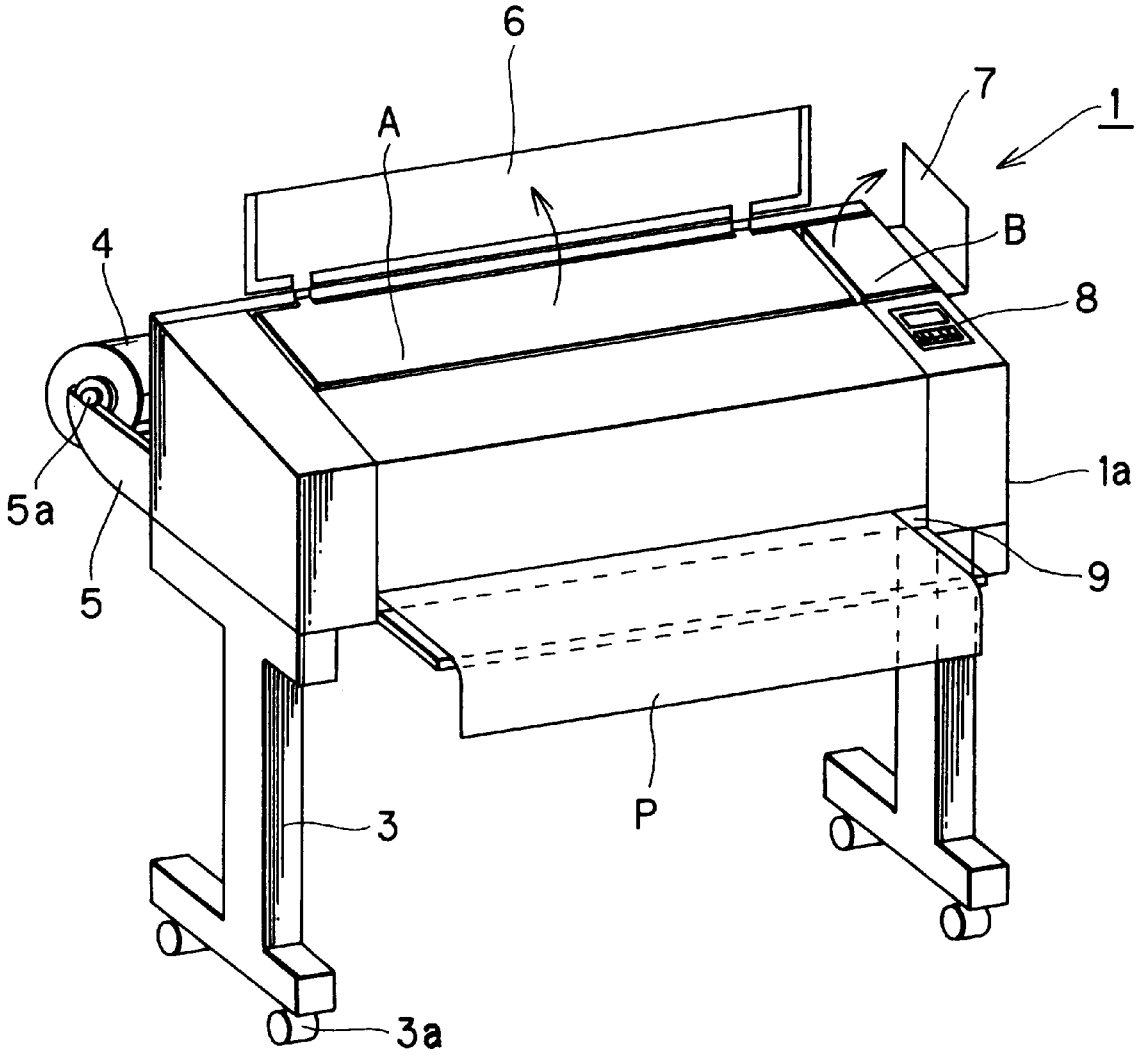
FIG. 3 is an external view of the image forming device of FIG. 2 when a main cover and a maintenance cover are in the open position.

FIG. 2 is an external view of the image forming device according to the preferred embodiment. FIG. 3 is an external view of the image forming device when a main cover and a maintenance cover are in their opened positions.

Directional terms, such as right, left, up, and down, will be used in the following description with reference to the state of the image forming device 1 located in an orientation as shown in FIG. 2.

The image forming device 1 of the present embodiment is a large-scale printer capable of recording images on a recording medium P having a large size, such as an A0-size paper, while freely setting a recording length to a desired amount. The image forming device 1 includes a main body 1*a* and legs 3 for supporting the main body 1*a* thereon. A support member 5 is provided on the back side portion of the main body 1*a*. The support member 5 is formed with depressions 5*a* for freely and rotatably supporting a recording paper roll 4 thereon. A desired length of a recording paper P (recording medium) is drawn from the recording paper roll 4 and is recorded with a desired image by the image forming device 1.

Figure 4:
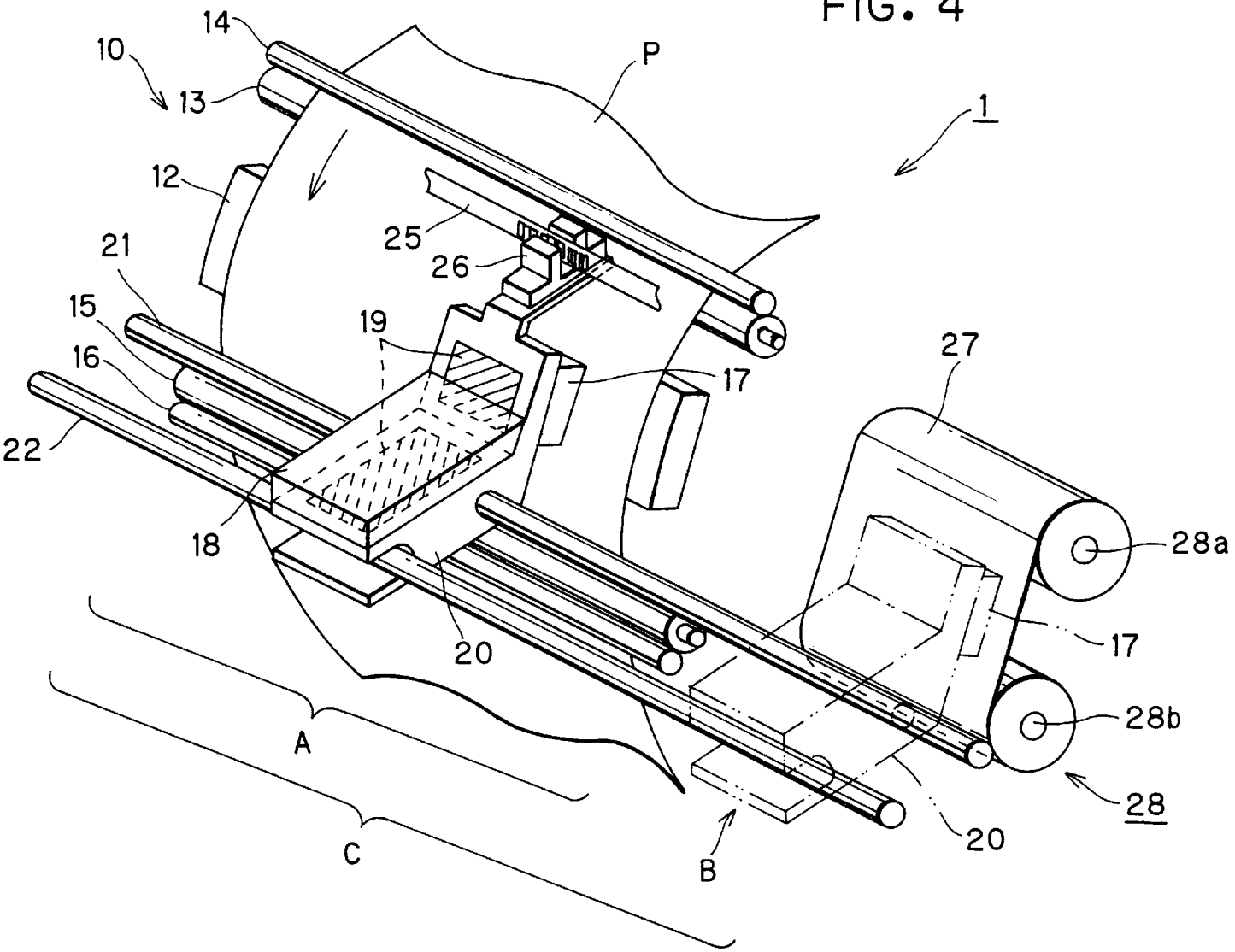
FIG. 4 is a perspective view showing the relevant construction of the recording mechanism in the image forming device.

A recording medium feed mechanism 10 shown in FIG. 4 is housed within the main body 1*a*. The recording medium feed mechanism 10 is provided at a recording area A. A recording head 17 is also provided within the main body 1*a*. The recording head 17 is for recording images on the recording medium P drawn from the recording paper roll 4. The recording head 17 is carried on a carriage 20. The recording head 17 performs its recording operation while the recording head 17 is move by the carriage 20 over the recording area A. As a result, the recording head 17 can form a desired image on the entire width of the recording medium P.

As shown in FIG. 2, a main cover 6 is provided on the top of the main body is to cover the recording area A. In other words, the main cover 6 covers the top portion of the recording head scanning area A, that is, the entire width of the recording paper P over which the recording head 17 scanningly moves during its recording operation. The main cover 6 can be freely opened and closed as shown in FIGS. 2 and 3, in order to allow access to the printing medium feed mechanism 10 and the recording head 17 for servicing. That is, through the opened cover 6, a user can clean and repair the printing medium feed mechanism 10 and the recording head 17.

As shown in FIG. 4, a maintenance mechanism 28 is housed within the main body 1*a* at a maintenance area B which is positioned adjacent to the recording area A. More specifically, the maintenance area B is located adjacent to the recording area A in the recording head moving direction. The recording head 17 can be carried by the carriage 20 in the entire recording head moving area C, in which the recording area A and the maintenance area B are located adjacent to each other. The maintenance mechanism 28 is for serving a maintenance operation onto the recording head 17 to maintain the recording head 17 in an appropriate state for recording.

As shown in FIG. 2, a small maintenance cover 7 is provided at the main body 1*a* separately from the main cover 6. The maintenance cover 7 is positioned to cover the maintenance area B. That is, to cover the top portion of the maintenance mechanism 28. The maintenance cover 7 can be freely opened and closed as shown in FIGS. 2 and 3, in order to allow access to the maintenance mechanism 28 and the recording head 17 for servicing. That is, through the opened cover 7, the user can clean and repair the maintenance mechanism 28 and the recording head 17 positioned at the maintenance area B.

A control panel 8 including various operating switches is provided on the top surface of the main body 1*a*. A printing medium delivery opening 9 is provided in the front surface of the main body 1*a* for delivering the freshly printed recorded medium P. Casters 3*a* are installed on the bottom portions of the legs 3 to facilitate moving of the image forming device 1.

The recording head 17, the recording medium feed mechanism 10, and the maintenance mechanism 28 will be described below in greater detail.

As shown in FIG. 4, a plate-shaped platen 12 is provided within the main body 1*a* for receiving the recording medium P drawn from the roll of paper 4. A main roller 13 and a pressure roller 14 are provided on the upper side of the platen 12 to feed the paper P for printing. A delivery roller 15 and a pressure roller 16 are provided on the lower side of the platen 12 to expel the paper P that has been printed. These rollers 13 through 16 extend over the entire recording area A. The recording medium P is held against the rollers 13 and 15 by the pressure rollers 14 and 16, respectively. The main roller 13 and the delivery roller 15 are rotated by a drive mechanism 30 (shown in FIG. 5), which includes a drive motor and a gear train. The rollers 13 and 15 cooperate to move the recording medium P by degrees in the direction shown by an arrow in FIG. 4. Hence, the paper feed mechanism 10 includes the rollers 13–16 and the drive mechanism 30 for driving these rollers 13–16.

Two guide bars 21 and 22 are provided in parallel to each other and to the platen 12. The guide bars 21 and 22 extend over the entire moving area C. The ends of these guide bars 21 and 22 are fixed in both side surfaces (not shown) of the main body 1*a*. The carriage 20 is freely supported on the guide bars 21 and 22 and can slide left and right along the same. The carriage 20 can therefore move over the entire moving area C.

The recording head 17 is mounted on the carriage 20 at a position opposing the platen 12 via the paper P. The recording head 17 is of an ink-jet type. An ink tank 18 and heaters 19 are also mounted on the carriage 20. The ink tank 18 is in fluid communication with the recording head 17. The ink-jet type recording head 17 can therefore print desired images onto the recording medium P through ejecting melted hot melt ink through its nozzles. The hot melt ink, which is in solid form at room temperature, has to be heated to reach a melted state. Accordingly, the heaters 19 are mounted on the recording head 17 and on the ink tank 18 in order to melt the hot melt ink into a liquid form.

A pump 29 (shown in FIG. 5) is provided in communication with the ink tank 18 to supply pressurized air to the ink tank 18. The pump 29 can therefore pressurize air on the liquid surface of ink stored in the ink tank 18, and can forcibly eject ink through the nozzles of the recording head 17. The pump 29 is thus for subjecting the recording head 17 to a purging operation. A pump drive mechanism 50 is provided to drive a motor 51 for energizing the pump 29.

A carriage drive mechanism 38 (shown in FIG. 5) is provided to drive the carriage 20 along the guide bars 21 and 22 over the entire recording head moving area C. The carriage drive mechanism 38 drives the carriage 20 in a scanning motion, left and right, over the recording area A across the recording medium P. Accordingly, the recording head 17, which is mounted on the carriage 20, can scan the recording medium P in its widthwise direction, thereby forming a desired ink image on the recording head medium P. The carriage drive mechanism 38 also moves the carriage 20 toward the maintenance area B at a prescribed timing to allow the print head 17 to be subjected to a maintenance operation.

A long strip-shaped slit member 25 is provided to extend horizontally, from left to right, above the carriage 20. A plurality of slits are printed in the slit member 25 at regular intervals. The slit member 25 is fixed to the main body 1*a* via a support member (not shown). An encoder 26 is provided on the carriage 20. The encoder 26 is constructed from a light emitting element and a light receiving element (not shown) which are disposed apart from each other. The encoder 26 is positioned so that the slit member 25 is sandwiched between the light emitting element and the light receiving element. The encoder 26 is for counting the slits in the slit member 25 while the carriage 20 moves horizontally. By counting slits in the slit member 25, the encoder 26 can detect the amount of movement by the carriage 20 and, therefore, the present position of the recording head 17.

Figure 5:
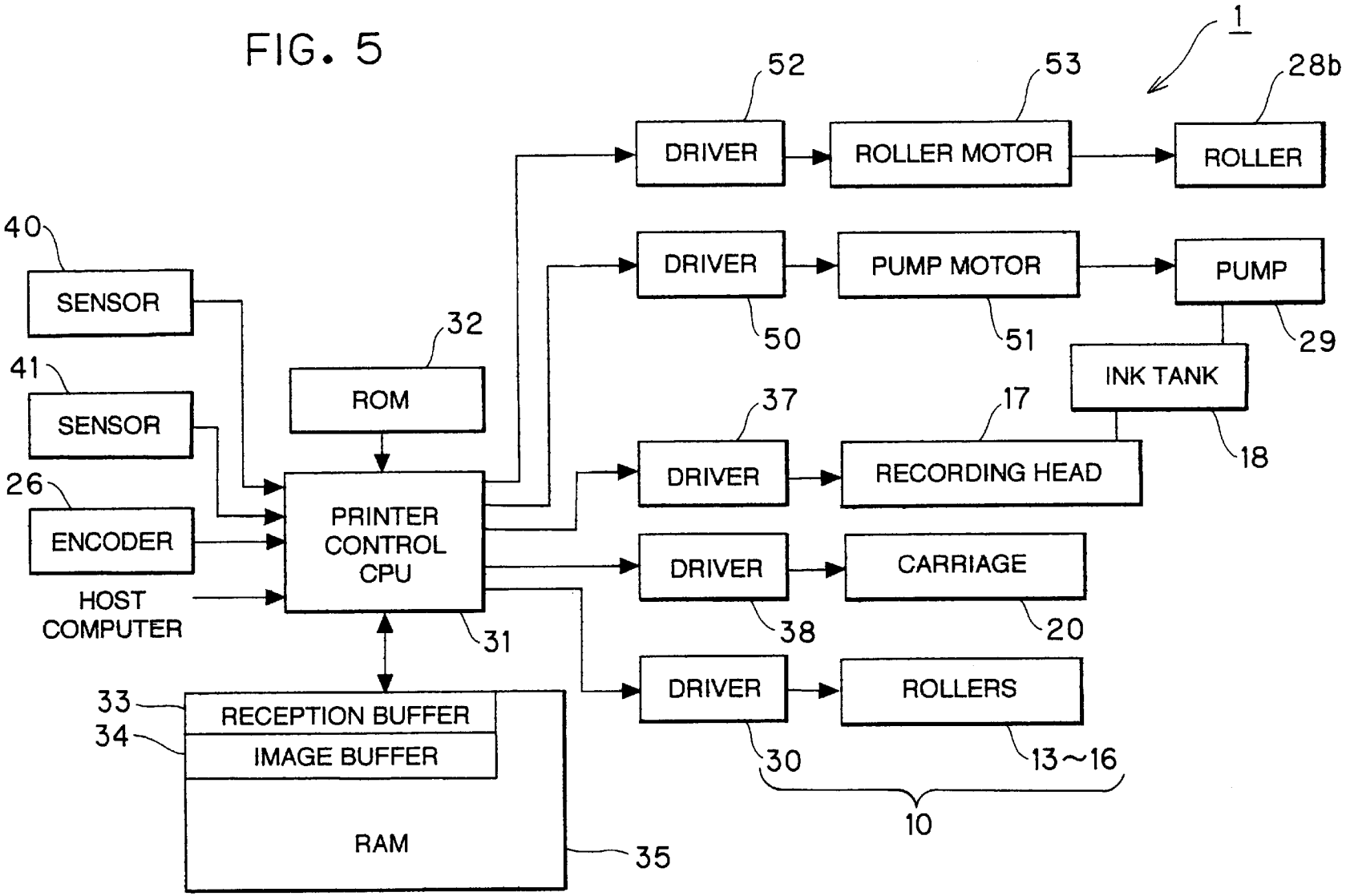
FIG. 5 is a block diagram of a control system provided to the image forming device.

The maintenance device 28 is positioned in confrontation with the recording head 17 when the recording head 17 is located at the maintenance position B. The maintenance device 28 is constructed from a support roller 28*a* for supporting a roll of a maintenance paper 27 and a take-up roller 28*b* for drawing the maintenance paper 27 from the roll of the paper. As shown in FIG. 5, a roller drive mechanism 52 is provided to drive a motor 53 for energizing the take-up roller 28*b*. The rollers 28*a* and 28*b* are positioned so that the maintenance paper 27 drawn by the roller 28*b* from the roller 28*a* moves while contacting the nozzle face of the recording head 17 with a uniform force when the recording head 17 is located in the maintenance position B.

With this structure of the maintenance device 28, when the recording head 17 is located in the maintenance position B, the recording head 17 is controlled to perform its purging operation. That is, the driver 50 drives the motor 51 to actuate the pump 29. The pump 29 supplies pressurized air to the ink tank 18 to pressurize ink in the ink tank 18, thereby forcibly ejecting ink through the nozzle of the recording head 17. As a result, air bubbles in the ink, ink dregs, and foreign material are ejected together with ink from the nozzles. Simultaneously, the driver 52 drives the motor 53 to rotate the take-up roller 28*b* to take up the maintenance paper 27. The maintenance paper 27 moves while contacting the nozzle face with a uniform force. The maintenance paper 27 moves when the nozzles forcibly eject ink. The maintenance paper 27 absorbs ink ejected from the nozzles, and wipes off the ink dregs and foreign material attached to the nozzle face of the recording head 17.

As shown in FIG. 5, the main body 1*a* is further provided with a sensor 40 for detecting the opened and closed states of the main cover 6 and another sensor 41 for detecting the opened and closed states of the maintenance cover 7.

As shown in FIG. 5, the image forming device 1 is provided with a printer control CPU 31. The CPU 31 is connected with a ROM 32, a RAM 35, the encoder 26, and the sensors 40 and 41. The RAM 35 is provided with a reception buffer 33 and an image buffer 34 for temporarily storing data received from a host computer (not shown). The ROM 32 is stored with a program for performing a printing operation based on the received data and for performing a purging process. The ROM 32 is also stored with data of patterns such as character fonts. The CPU 31 is also connected with: a driver 37 for driving the recording head 17 to perform recording operation; the driver 38 for driving the carriage 20; the driver 30 for driving the rollers 13–16; the driver 50 for driving the pump motor 51; and the driver 52 for driving the take-up roller motor 53. With the above-described structure, the recording head 17, the paper feed mechanism 10, the carriage 20, the maintenance device 28, and the like are controlled based on signals produced from the encoder 26.

Next, the recording operations of the image forming device 1 will be described.

While the carriage drive mechanism 38 moves the carriage 20 parallel to the platen 12 over the printing area A, the recording head 17 is driven by the head driver 37 to eject ink from selected nozzles, thereby recording images on the recording medium P set over the platen 12. When one scan is completed, that is, when the carriage 20 has made one complete left-to-right movement across the recording medium P over the entire printing area A, the paper feed mechanism 10 feeds the recording medium P forward a prescribed distance, setting the next line on the recording surface in position to be recorded.

It is noted that when power to the image forming device 1 is initially turned ON, that is, when a power switch (not shown) on the image forming device 1 is switched to the ON position to supply power to the image forming device 1, the controller 31 supplies electric power to the drive motor in the carriage drive mechanism 38, thereby moving the recording head 17 to the maintenance position B, indicated by the broken line on the right side of FIG. 4. The recording head 17 is then subjected to the purging process and cleaned by the replaceable maintenance paper 27. More specifically, the pump driver 50 actuates the pump motor 51 to energize the pump 29 to pressurize the ink in the ink tank 18, thereby forcibly ejecting ink from all the nozzles. Simultaneously, the roller driver 52 actuates the take-up roller 53 to rotate the take-up roller 28*b* to take up the maintenance paper 27 form the supply roller 28*a*. The maintenance paper 27 moves while contacting the nozzle face of the recording head 17 with a uniform force, thereby absorbing ink ejected from the nozzles and wiping off ink dregs and foreign material attached to the nozzles.

It is noted that the maintenance cover 7 is provided above the maintenance position B. Accordingly, when the entire roll of the maintenance paper 27 has been used, this maintenance cover 7 is opened and the maintenance paper 27 is replaced with a new roll. A lamp can preferably be provided on the control panel 8 to become lit when the entire roll of maintenance paper 27 has been used, warning the user to replace the maintenance paper 27 with a new one.

It is also noted that the maintenance operation for purging the nozzles of the recording head 17 can be performed, for example, each time the power is turned on, each time a specified amount of recording data is recorded by the recording head 17, and/or each time onto page of image data is recorded. The maintenance position B can also be used to replace, with a new one, a four-colored ink cartridge (not shown) provided on the carriage 20. A warning, like that described above, can be issued when the ink cartridge needs to be replaced with a new one.

When the main cover 6, provided for servicing the recording medium feed mechanism 10 and the print head 17, is opened during recording operations, the recording operations are forcibly stopped in order to maintain a safe work environment. However, when the maintenance cover 7 is opened during recording operations in order to replace the maintenance paper 27 with a new one or to service the maintenance mechanism 28, recording operations are not stopped.

It is now assumed that the sensor 40 detects that the main cover 6 is opened while the drivers 30, 37, and 38 control the rollers 13–16, the recording head 17, and the carriage 20 to perform printing operation. When the sensor 40 supplies the CPU 31 with a signal indicative of the opened state of the main cover 6, the CPU 31 controls the drivers 30, 37, and 38 to stop their printing operation.

It is further assumed that the sensor 41 detects that the maintenance cover 7 is opened while the drivers 30, 37, and 38 perform printing operation. When the sensor 41 supplies the CPU 31 with a signal indicative of the opened state of the maintenance cover 7, however, the CPU 31 continues controlling the drivers 30, 37, and 38 to perform printing operation.

As described above, in the image forming device 1 according to the present embodiment, opening the cover 7 to replace the maintenance paper 27 with a new one is extremely easy. This is because the maintenance cover 7 is small and provided separately from the main cover 6 used for servicing the recording medium feed mechanism 10 and the printing head 10. Opening the small maintenance cover 7 is much easier than opening the large cover on the conceivable image forming device. This is because the conceivable cover is almost as wide as the image forming device itself. Further, by providing a separate maintenance cover 7, the main cover 6 can also be made smaller, thereby reducing the effort required to open the main cover 6.

In addition, the maintenance cover 7 can be opened for replacing the maintenance paper 27 with a new one while the recording head 17 is recording on the recording medium P, without exposing the recording head 17 to the outside air and lowering the temperature of the same. Hence, replacing the maintenance paper 27 with a new one will not change the melting temperature of the hot melt ink and, therefore, will not have an undesirably effect on ink ejection.

Further, recording operations will not be halted even if the maintenance cover 7 is opened while the recording head 17 is recording. Hence, replacing the maintenance paper 27 with a new one will not reduce recording efficiency. Various maintaining operations other than the replacement of the maintenance paper 27 with a new one can be performed easily without effecting any undesirable effects on the recording operation.

Thus, according to the present embodiment, when opening the main cover 6, the user can clean and repair the sheet feeding mechanism 10, clean and repair the print head 17, and remove a paper jammed between the rollers 13–16. When opening the maintenance cover 7, the user can replace, with a new one, the maintenance paper roll supported on the roller 28*1*, clean and repair the maintenance device 28, and replace, with a new one, the ink cartridge mounted on the carriage 20.

While the invention has been described in detail with reference toe the specific embodiment thereof, it would be apparent to those skilled in the art that various changes and modifications may be made therein without departing from the spirit of the invention.

For example, when the sensor 40 detects that the main cover 6 is opened while the drivers 50 and 52 control the pump 29 and the take-up roller 28*b* to perform purging operation, the CPU 31 may control the drivers 50 and 52 to stop their purging operation. Similarly, when the sensor 41 detects that the maintenance cover 7 is opened while the drivers 50 and 52 perform purging operation, the CPU 31 may control the drivers 50 and 52 to stop their purging operation.

In the above-described embodiment, the main cover 6 is provided with the sensor 40, and the maintenance cover 7 is provided with the sensor 41. However, only the main cover 6 may be provided with the sensor 40. The maintenance cover 7 may not be provided with the sensor 41. Regardless of whether the maintenance cover 7 is opened or closed, the printing operation and the purging operation is stopped when the sensor 40 detects that the main cover 6 is opened. In this modification, the sensor 40 may be configured from a switch attached to the main cover 6. The switch is electrically connected between a power supply (not shown) and the drivers 30, 37, 38, 50, and 52. When the main cover 6 is closed, the switch automatically connects the power supply (not shown) to the drivers 30, 37, 38, 50, and 52. When the main cover 6 is opened, the switch automatically disconnects the power supply (now shown) form the drivers 30, 37, 38, 50, and 52. With this structure, when the main cover 6 is opened, the printing operation and the purging operation is stopped.

In the embodiment described above, recording operations are suspended when the main cover 6 is opened. However, the image forming device 1 can be configured to continue recording operations even if the main cover 6 is opened.

In the embodiment described above, the recording head 17 is cleaned in the maintenance position B using the maintenance paper 27. However, the recording head 17 can be cleaned using different methods other than the maintenance paper 27. For example, as described in Japanese Patent Application Publication Kokai No. 5-278229, the maintenance device 28 may be designed to suck ink from the nozzles of the recording head 17.

In the embodiment described above, hot melt ink is used in the recording head 17. However, it is also possible to use an ink in liquid form even at room temperature.

In the above-described embodiment, the pump 29 is energized by the motor 51, and the take-up roller 28*b* is energized by the motor 53. However, only a single motor may be provided to energize both the pump 29 and the take-up roller 28*b* simultaneously. The single motor can be controlled by a single driver.

According to the image forming device as described above, the maintenance cover 7 is provided separately from the main cover 6 in order to cover the maintenance mechanism 28. The maintenance cover 7 can be made relatively small, providing that it is sufficiently large to allow access for servicing the maintenance mechanism 28.

By using this maintenance cover 7, opening the cover 7 to service the maintenance mechanism 28 becomes extremely easy. This is because it is not necessary to open a cover as large as the cover used on the conceivable image forming device, which conceivable cover is almost as wide as the image forming device itself.

Further, by providing a separate maintenance cover 7, the main cover 6 can be made smaller by the width of the maintenance cover 7, thereby recording the effort required to open the main cover 6.

In addition, by only opening the maintenance cover 7 for servicing the maintenance mechanism 28 and the like while the recording head 17 is positioned in the recording area A, the temperature of the recording head 17 is not lowered. Hence, servicing of the maintenance mechanism 28 and the like will not have an undesirable effect on ink ejection. Further, when servicing the maintenance mechanism 28, the user will not mistakenly touch the recording medium P and, therefore, will not cause ink smears or otherwise dirty the recording medium P.

According to the image forming device as described above, recording operations are stopped when the main cover 6 is opened, but not when the maintenance cover 7 is opened. For this reason, a safe environment is established for maintenance work performed on the mechanisms 10 and 17 accessed through the main cover 6, while the maintenance mechanism 28 can be serviced through the maintenance cover 7 even during recording operations. Hence, servicing of the maintenance mechanism 28 and the like can be performed without lowering the temperature of the recording head 17 and without reducing recording efficiency.

According to the image forming device as described above, the temperature of the recording head 17 is raised in order to melt the hot melt ink, which is in a solid state at room temperature. When the main cover 6 is opened, the recording head 17 is exposed to the outer air, which can cool the recording head 17 and prevent the ink from melting properly. However, the maintenance paper 27 can be replaced with a new one by opening the maintenance cover 7 rather than the main cover 6, thereby avoiding such problems.

What is claimed is:

1. An image forming device comprising:

a recording medium feed mechanism for feeding a recording medium at a predetermined recording scanning area;

a recording head capable of recording images on the recording medium fed at the predetermined recording scanning area;

a scanning mechanism for moving the recording head relative to the recording medium to cause the recording head to scan the recording medium at the recording scanning area and for moving the recording head to a maintenance area which is positioned adjacent to the recording scanning area;

a maintenance mechanism provided at the maintenance area for performing a maintenance operation onto the recording head;

a device main body enclosing therein the recording medium feed mechanism, the recording head, the scanning mechanism, and the maintenance mechanism;

a main cover provided to the device main body at the recording scanning area, the main cover being capable of being opened and closed with respect to the device main body, the main cover being opened to enable an access to the recording medium feed mechanism and the recording head being positioned at the recording scanning area; and a maintenance cover provided to the device main body at the maintenance area, the maintenance cover being capable of being opened and closed with respect to the device main body, the maintenance cover being opened to enable an access to the maintenance mechanism.

2. An image forming device as claimed in claim 1, further comprising:

a main cover sensor for detecting whether the main cover is opened or closed;

a maintenance cover sensor for detecting whether the maintenance cover is opened or closed; and a controller for controlling the recording head, the recording medium feed mechanism, and the scanning mechanism to stop the recording operation when the main cover sensor detects that the main cover is opened and for controlling the recording head, the recording medium feed mechanism, and the scanning mechanism not to stop the recording operation even when the maintenance cover sensor detects that the maintenance cover is opened.

3. An image forming device as claimed in claim 1, wherein the maintenance mechanism includes a support mechanism for supporting a maintenance paper at the maintenance area for cleaning the recording head with the maintenance paper.

4. An image forming device as claimed in claim 1, wherein the recording head includes:

a heater for heating a hot-melt type into a liquid state; and an ink-ejection recording head for ejecting the liquid state hot melt-type ink into the recording medium.

5. An image forming device as claimed in claim 1, further comprising:

a main cover sensor for detecting whether the main cover is opened or closed; and a controller for controlling the recording head, the record medium feed mechanism, the scanning mechanism and the maintenance mechanism to stop recording and maintenance operations when the main cover sensor detects that the main cover is opened, regardless of whether the maintenance cover is opened or closed.

6. An image forming device as claimed in claim 1, further comprising a controller controlling the recording head, the recording medium feed mechanism, and the scanning mechanism to stop the recording operation when the main cover is opened, while not controlling the recording head, the recording medium feed mechanism and the scanning mechanism to stop the recording operation when the maintenance cover is opened.

7. An image forming device as claimed in claim 6, further comprising:

a main cover sensor for detecting whether the main cover is opened or closed; and a maintenance cover sensor for detecting whether the maintenance cover is opened or closed; and wherein the controller include a control portion for controlling the recording head, the recording medium feed mechanism, and the scanning mechanism to stop the recording operation when the main cover sensor detects that the main cover is opened and for controlling the recording head, the recording medium feed mechanism and the scanning mechanism not to stop the recording operation even when the maintenance cover sensor detects that the maintenance cover is opened.

8. An image forming device as claimed in claim 6, wherein the maintenance mechanism includes a support mechanism for supporting a maintenance paper at the maintenance area for cleaning the recording head with the maintenance paper.

9. An image forming device as claimed in claim 6, wherein the recording head includes:

a heater for heating a hot-melt type ink into a liquid state; and an ink-ejection recording head for ejecting the liquid state hot melt-type ink onto the recording medium.

10. An image forming device as claimed in claim 6, further comprising a main cover sensor for detecting whether the main cover is opened or closed; and wherein the controller includes a control portion for controlling the recording head, the recording medium feed mechanism, the scanning mechanism and the maintenance mechanism to stop recording and maintenance operations when the main cover sensor detects that the main cover is opened, regardless of whether the maintenance cover is opened or closed.

11. An image forming apparatus comprising:

a recording device for scanning and recording images on a recording medium;

a maintenance mechanism positioned adjacent to one end of the area scanned by the recording device during recording operations;

a recording medium feed mechanism for feeding the recording medium relative to the recording device;

a device body housing the recording device, the maintenance mechanism, and the recording medium feed mechanism;

a main cover attached to the device body and being capable of freely opening and closing, the main cover covering over the recording medium feed mechanism and the area scanned by the recording device during recording operations; and a maintenance cover attached to the device body and being capable of freely opening and closing, the maintenance cover being provided separately from the main cover and covering over the maintenance mechanism.

12. An image forming apparatus as claimed in claim 11, further comprising control means for controlling the recording device to stop the recording operations when the main cover is opened, while not controlling the recording device to stop the recording operations when the maintenance cover is opened.

13. An image forming apparatus as claimed in claim 12, wherein the recording device includes a recording head, the maintenance mechanism supporting a maintenance paper for cleaning the recording head.

14. An image forming apparatus as claimed in claim 12, wherein the recording device uses a hot melt-type ink for recording images.

15. An image forming apparatus as claimed in claim 11, wherein the recording device includes a recording head, the maintenance mechanism supporting a maintenance paper for cleaning the recording head.

16. An image forming apparatus as claimed in claim 11, wherein the recording device uses a hot melt-type ink for recording images.

17. An image forming apparatus comprising:

a housing defining therein a predetermined printing area and a predetermined maintenance area;

a recording medium feed mechanism mounted in the housing for feeding a recording medium within the predetermined printing area;

a recording device provided in the housing to be movable within the predetermined printing area and the predetermined maintenance area, the recording device performing recording operations, in the predetermined printing area, to record images on the recording medium;

a main cover attached to the housing at the predetermined printing area and being capable of freely opening and closing; and a maintenance cover attached to the housing at the predetermined maintenance are and being capable of freely opening and closing, the maintenance cover being provided separately from the main cover.

18. An image forming apparatus as claimed in claim 17, further comprising control means for controlling the recording device to stop its recording operations when the main cover is opened, while not controlling the recording device to stop the recording operations when the maintenance cover is opened.

* * * * *